United States Patent [19]

Reijenga

[11] Patent Number: 5,054,633

[45] Date of Patent: Oct. 8, 1991

[54] TAMPER EVIDENT SAFETY CLOSURE

[75] Inventor: Tjerk Reijenga, Oisterwijk, Netherlands

[73] Assignee: Technoplast B.V., Tilburg, Netherlands

[21] Appl. No.: 454,984

[22] Filed: Dec. 22, 1989

[30] Foreign Application Priority Data

Dec. 27, 1988 [NL] Netherlands ..... 8803179

[51] Int. Cl.[5] ..... B65D 55/02

[52] U.S. Cl. ..... 215/220; 215/203; 215/251

[58] Field of Search ..... 215/203, 219, 220, 250, 215/251

[56] References Cited

U.S. PATENT DOCUMENTS 4,171,236 10/1979 Winchell et al. ..... 215/251 X
4,527,701 7/1985 Schaubeck ..... 215/220
4,555,036 11/1985 Bekkers et al. ..... 215/220
4,632,264 12/1986 Evans ..... 215/220
4,669,620 6/1987 Coifman ..... 215/220

*Primary Examiner*—Stephen Marcus
*Assistant Examiner*—Nova Stucker
*Attorney, Agent, or Firm*—Fleit, Jacobson, Cohn, Price, Holman & Stern

[57] ABSTRACT

A tamper evident safety closure for containers composed of an assembly of an inner cap and an outer cap, the inner cap provided with threading for screwing onto the mouth of a container. The outer cap can be depressed over the inner cap against a resilient force and the caps can be unscrewed from a container only after depressing the outer cap. A central upstanding part on the inner cap cooperates with a bridging wall portion, bridging a central opening in the top wall of the outer cap and connected thereto by a rupturable connection. There is an asymmetry in these parts so that the bridging wall portion does not rupture instantaneously all around its periphery but either remains connected to the outer cap with showing plastic deformation or ruptures gradually around its periphery or both.

22 Claims, 3 Drawing Sheets

TAMPER EVIDENT SAFETY CLOSURE

BACKGROUND OF THE INVENTION

This invention relates to tamper evident safety closures for containers of a general type as e.g. disclosed in U.S. Pat. Nos. 4,527,701 and 4,555,036. Such closures have two caps, one, a so called inner cap, to be screwed onto a container to be closed and the other one, a so called outer cap, in which the inner cap is housed. The caps have a top wall and a skirt at the outer periphery thereof, the skirt of the outer cap surrounding the skirt of the inner cap. Spring means urge the caps axially apart and retaining means limit such separating movement. Cam or ratchet means allow the caps to rotate in one direction with respect to each other, whereas on rotation of the outer cap in the opposite direction the inner cap is rotated with the outer cap by the cam of ratchet means. Axial depression of the outer cap towards the inner cap against the spring means brings parts of the cam or ratchet means in cooperation, that make rotation of the outer cap in said one direction cause rotation of the inner cap with the outer cap. These directions are chosen in relation to the direction of screw-threading the inner cap onto the container so that the closure can be screwed onto the container with its inner cap by rotating the outer cap without depressing it towards the inner cap, while screwing the closure off from the container can only take place after such depressing. This makes the closure safe in the hands of children, which cannot open the container as this requires a depression of the outer cap before the closure can be screwed off therefrom.

It is moreover known from said U.S. patent specifications to provide the inner cap with a central upwardly protruding part and to provide the top wall of the outer cap with a central opening, which is bridged by a bridging wall portion, connected by a rupturable connection to said top wall, so that, on depressing the outer cap for the first time, said protruding part of the inner cap ruptures said connection to separate the bridging wall portion from the outer cap. This makes it visible at once that the outer cap has been depressed, so that the closure may have been tampered with.

Closures with such rupturable bridging wall portions have, however, several disadvantages, one being that it may be put and pushed back in place, so that tampering is not immediately evident, the other one being that the bridging wall portion may be propelled away on rupturing of the connection, may get lost, swallowed by children, fall into foodstuffs or hit the eye of a person or such disadvantage. It has thus been proposed in said U.S. Pat. No. 4,527,701 to apply not only a rupturable connection, but also at least one non rupturable connection between said bridging wall portion and the top end wall of the outer cap. Although this may remove the said second disadvantage, it will not remove the first one, in particular not if the non rupturable connection is a thin curved bridge part being easily deformable to allow some upward movement of the bridging wall portion with respect to the top end wall of the outer cap, as it will also allow downward movement of said bridging wall portion thereafter, back again to its original shape and position, in which this connection is mainly out of sight below the top end wall of the bridging wall portion.

OBJECTS AND SUMMARY OF THE INVENTION

The invention aims at improving such closures in these respects. To this end there are proposed means to warrant that the rupturable wall portion bridging the opening in the outer cap will, when the outer cap is depressed, deform plastically so that it cannot be moved back to its original position when the outer cap is not kept depressed any more, and means to avoid sudden full rupturing of the rupturable connection so that it will not be catapulted from the closure, which means may also be combined if desired. This will be described in more detail below.

DESCRIPTION OF THE DRAWINGS

Hereinafter, the invention is further elucidated by means of a preferred embodiment which is illustrated in the drawings in which.

DETAILED DESCRIPTION

Figure 1:
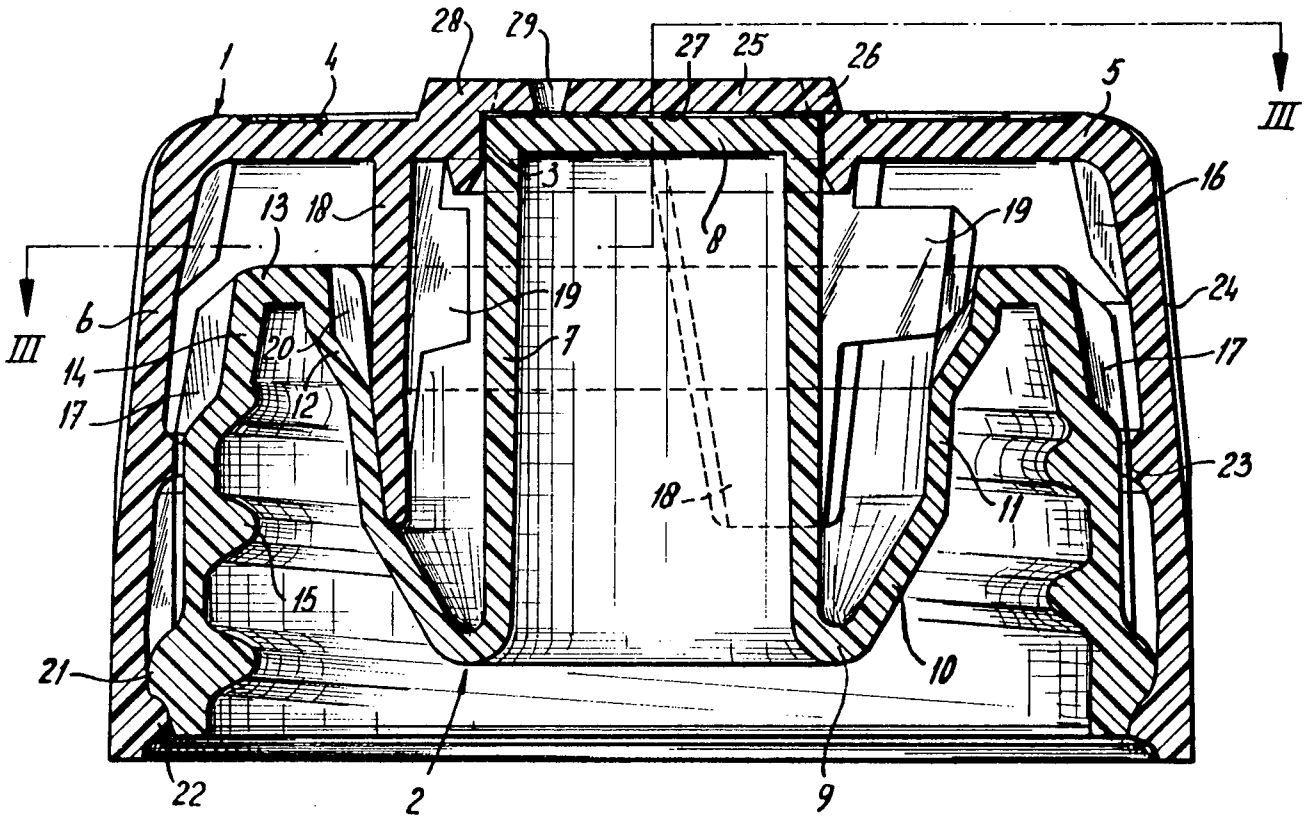
FIG. 1 is a vertical (axial) section of an invented safety closure.

From the figures of the drawing, the safety closure comprises combined outer cap 1 and inner cap 2 loosely assembled as will be explained in detail hereinafter. The inner cap 2 and outer cap 1 are molded from suitable, safe for human use, plastic materials, in a manner known in the art. The outer cap 1 is provided with a top end wall portion 4 in which a central opening 5 is located. A substantially cylindrical skirt portion 6 depends from the outer peripheral edge of the end wall portion 4.

The inner cap 2 comprises a central cylindrical portion 7, closed at its top 8, and an external skirt portion 14, which is provided with integrally molded screw threads 15 to enable the closure to be mounted onto the mouth of a container having complementary screw threads, all as well known in the art. The external skirt portion 14 is integrally connected, by means of an intermediate wall portion 13 including a conical portion 10, with the cylindrical portion 7. The wall forming the opening 3 in top end wall portion 4 of outer cap 1 engages around and is guided by the cylindrical portion 7 on the inner cap 2, when the outer cap 1 is pressed downwardly relative to inner cap 2.

The end wall portion 4 of the outer cap 1 is provided with inwardly extending resilient or springy lips 18, at least two and preferably not more than four, which point or depend into the space created between the cylindrical portion 7 and the intermediate wall portion 11 of the inner cap 3. The lips 18 coact with and cooperate with the inner surface of conical portion 10 of this intermediate wall portion 11 in such a manner that in the unstressed or repose condition of the safety closure (no downward pressure on outer cap 1), the caps are maintained in the mutual position shown in FIG. 1. In case a pressing force is effected upon the outer cap 1, these lips 18 are guided along the conical portion 10 of the intermediate wall portion 11 on the inner cap 2 and are flexed inwardly increasing the bias to restore the outer cap 1 to the condition shown in FIG. 1, to which cap 1 will return when the pressing force is released.

The outer surface of skirt portion 14 of the inner cap 2 is provided with peripherally spaced, radial rib-like teeth 17, pointing substantially radially, which cooperate and interengage, respectively, with peripherally spaced, radial rib-like teeth 16 formed on the inner surfaces of cylindrical skirt portion 6 and end wall portion 4. Teeth 17 and 16 will engage when outer cap 1 has been moved axially downwardly a predetermined distance relative to inner cap 2. This occurs against the bias or pressing force exerted upwardly upon the outer cap 1 by the spring or resilient force of the lips 18 as they are deflected due to following the conical portion 10.

The surface 12 of the intermediate wall 11 which faces inwardly toward the cylindrical portion 7 is provided at its upper end with radially extending, peripherally spaced, rib-like teeth 20. The lips 18 on the outer cap 1 are each provided with a tangential protrusion 19, having a length in the axial direction less than the axial length of the lips 18. These protrusions 19 are curved into the region or plane of teeth 20 and are interengaging with the teeth 20 both in the condition shown in FIG. 1 and when downward pressure is exerted upon outer cap 1 of the closure to effect interengagement of teeth 17 and 16. The combined closure can thus be onscrewed upon a container mouth by the protrusions 19 of the lips 18 which provide a sufficient rigidity in a tangential direction to interengage with teeth 20. In the direction reverse to onscrewing, namely, the offscrewing direction, the protrusions 19 provide sufficient flexibility so that upon turning of the outer cap 1 in this reverse direction, the protrusions 19 slide past the teeth 20, due to their flexibility, thereby causing a rattling noise, informing the user by an audible signal to initiate some activity for unscrewing the closure. The teeth 20 and protrusions 19 have the effect of a ratchet, allowing onscrewing but preventing offscrewing except when outer cap 1 is pushed down. The user must achieve offscrewing by pressing down the outer cap 1, thereby causing interengagement of the teeth 16 of the outer cap 1 with the teeth 17 of the inner cap 2 after which the closure can be unscrewed and removed from the mouth of the container. Rotation of the outer cap 1 by hand is facilitated by a roughened or knurled outer wall 24 thereof. At 23 the inner and outer caps are guided mutually against sideways movements.

For loosely keeping the outer and inner caps assembled, the outer cap is provided at its open bottom with a rim 22 extending radially and which overlaps an outer rim 21 provided on the inner cap. The inner and outer caps are manufactured from material with elastic properties, particularly from plastic material, and accordingly, the inner and outer caps are easily mountable and demountable, respectively, by elastic deformation.

All this in essence corresponds to the closure known from the above-mentioned U.S. Pat. No. 4,555,036. The central opening 3 of the top wall portion 4 of the outer cap 1 is protected, covered or locked by a bridging wall portion 25 which is connected to top wall portion 4 by a tearable or rupturable connection, which will now be described in detail with reference to FIGS. 1 and 2.

Figure 2:
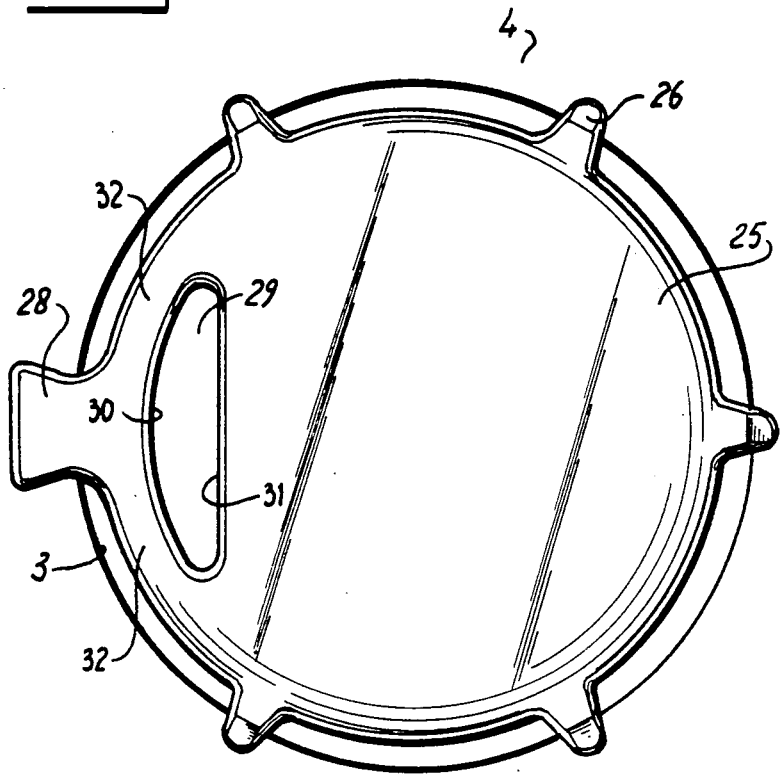
FIG. 2 is a top view of the central top part thereof.
Figure 3:
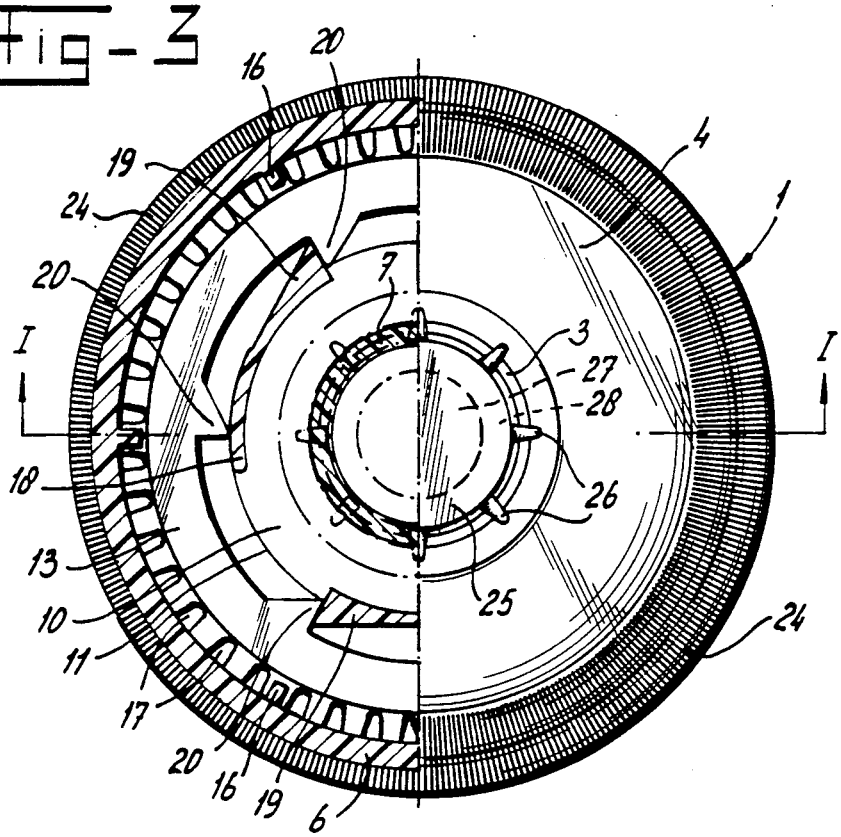
FIG. 3 is a view and horizontal section of this closure along the line III—III in FIG. 1.

As shown in FIG. 2, there is a rupturable connection, here consisting of five discrete narrow, rupturable connections 26, and there is a much wider (more than twice as wide) connection 28, both between the wall portion 25 and the top wall 4 of the outer cap 1. These connections 26 and 28 are evenly distributed around the periphery of the opening 3 in the outer cap.

In wall portion 25 there is a throughgoing opening 29, which is elongate and symmetrical with respect to a diameter of circular wall portion 25 and passes centrally through connection 28. Its outer edge 30 is circular with its center of curvature in the center of wall portion 25. Its inner edge 31 is straight (FIG. 2). This means that, between this outer edge 30 and the outer periphery of wall portion 25 two narrow zones 32 are formed in the wall portion 25.

The operation thereof is as follows. When the outer cap 1 is pressed down on the inner cap to begin unscrewing of the closure from a container, the top wall 8 of part 7 of inner cap 2 will contact lower surface 27 of wall portion 25 and upon further depression of the outer cap will exert an increasing upward force on wall portion 25, which force is taken up by the connections 26 and 28 thereof with the top end wall 4 of the outer cap. The connections 26 are chosen so strong that, before they rupture by this force, the wall portion 25 is moved upwardly, thus deforming the narrow zones 32 by bending them upwardly from the stronger (here: wider) connection 28 and then back into the plane of the wall portion 25. By a suitable choice of materials and dimensions of parts, this goes on until this bending gives plastic (more than elastic) and thus permanent deformation of the zones 32, after which, on further depression of the outer cap 1 the connections 26 will rupture. This has two effects: the wall portion 25 will remain attached to the outer cap 1 through connection 28, and the wall portion 25 will be so deformed plastically in the zones 32 that it is not possible to push it down back to its original position after terminating the depressing of the outer cap 1 with restoration of the zones 32 to their original shape, as they will always show a deformation upwardly and then back into the main plane of wall portion 25, so that it always remains visible that the outer cap 1 has been depressed, so that the closure may have been tampered with FIG. 1 is on a scale which depends upon the dimensions of the neck of the container, onto which it has to be screwed, and in a practical embodiment FIG. 1 is often shown at about four times the real dimensions. The caps are made of a somewhat elastic, not too hard synthetic resin material, easily allowing tolerances in the dimensions of the neck of the container, and suitable materials for this are e.g. polyethylene for the inner cap 2 and polypropylene for the outer cap 1, the latter easily allowing plastic deformation after some elastic deformation. It is easy for the expert to choose dimensions and materials to obtain the desired effects of plastic deformation of zones 32 before the connections 26 rupture.

There may be more than one non rupturable connection 28 with such an opening 29 nearby, e.g. two of them, diametrically opposite, with rupturable connections 26 between them.

Figure 4:
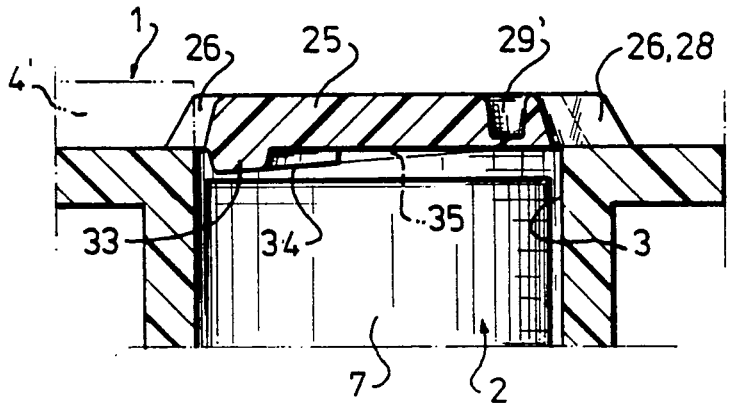
FIG. 4 is a vertical section of the central part of the outer cap of the novel and improved closure in a different embodiment.

FIG. 4 shows another embodiment of a closure according to the invention, showing wall portion 25 and its immediate surroundings. Here all connections may be of the rupturable type as indicated by 26, or there may also be a not or not easily rupturable connection, as 28 in FIG. 2, in this case at the right in FIG. 4. The lower surface 27 of wall portion 25 has a downwardly directed protruding part 33, being either a single cam of very limited peripheral extension or a cam extending peripherally over a considerable part of the periphery of wall portion 25. Such a small cam may have the same height (the same level of its lower surface), but particularly a cam taking up a considerable part of the periphery will preferably have a varying height, e.g. as a flat but inclined plane, as shown in FIG. 4 by 34. The total bottom wall of wall portion 25 may also be in a continuous inclined plane as given by dotted line 35. Part 7 of the inner cap 2 in this case has a top surface in a lower position than in FIG. 1, as shown. In this embodiment the depression of the outer cap 1 onto the inner cap 2 will cause that the rupturable connections 26 do not rupture simultaneously, so that no strong action of jettisoning the rupturable wall portion 25 occurs, but the rupturable connection (or two of them) closest to the lowest point of cam 33 will rupture first and the others only later on. The wall portion 25 is thus not propelled away strongly on rupturing. This may even cause that one connection 26 will not be ruptured after the others have been ruptured. If this last connection is made stronger (here: wider), as is connection 28 in FIG. 1, wall portion 25 remains attached to outer cap 1. In that case, this embodiment may be combined with the embodiment of FIG. 1 in that wall portion 25 also has such an opening 29 and narrow zones 32 alongside it, not shown here, but as shown in FIGS. 1 and 2, deforming plastically before the connections 26 rupture, e.g. before at least several of them have been ruptured. In FIG. 4 the opening 29 is shown as 29', being an opening, which does not extend fully through wall portion 25, but is closed by a thin bottom part.

Figure 5:
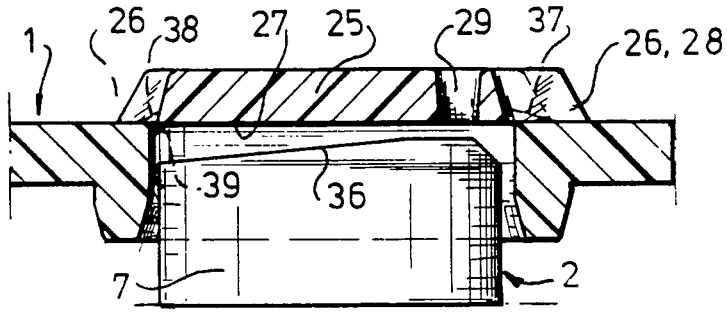
FIG. 5 is a vertical section of the central part of the outer cap of a closure according to the invention in still another embodiment.

In FIG. 5 the lower wall 27 of wall portion 25 is flat and perpendicular to the axis of the caps over its entire extension, but in this case the top surface 36 of cylindrical portion 7 is somewhat inclined with respect to the axis thereof (or has a cam part like 33 in FIG. 4, but upstanding instead of downwardly directed). This will also cause the rupturable connections 26 not to rupture simultaneously, but first at the right and later on in zones more to the left in FIG. 5. Also in this case, one of these connections may be a non-rupturable connection as 28 in FIGS. 1 and 2. In this case this may as well be the right or the left one, and there may be such an opening 29 as in FIGS. 1 and 2 to deform wall portion 25 plastically on rupturing, close to such a connection 28.

If this non rupturable connection 28 and opening 29 are provided at the right, as shown, the narrow zones to the side of opening 29 (32 in FIG. 2) will first deform plastically before the connections 26 rupture.

If this non rupturable connection 28 and opening 29 would be at the left in this figure, connection 28 should be made so strong (e.g. so wide) that the connections 26 would rupture first and then the narrow zones 32 (FIG. 2) to the sides of opening 29 would also deform plastically, but in a different shape, curving more in one direction concavely upwardly instead of bending concavely up near connection 28 and than convexly back into the plane of wall portion 25.

Instead of discrete rupturable connections 26 there may be a thin rupturable continuous rim or diaphragm all around, connecting wall portion 25 to the top end wall 4 of the outer cap 1, and such a rim may have a top surface as shown dotted at 37 at the right in FIG. 5, with the same flat horizontal lower surface as connections 26, or it may have a shape as shown in dotted lines at the left in FIG. 5, with top surface 38 and lower surface 39. The thickness of this rim or diaphragm may change gradually or in steps around the periphery of wall portion 25, so as to be thinner where it has to rupture first and become thickest in the zone where it has to rupture last or not al all.

If it is desired, when piling containers with such closures one on top of the other, to avoid more safely an accidental rupturing of one of the connections by the weight of the containers on top thereof, wall portion 25 may be positioned lower, in the opening 3, with the connections 26 and, if present, 28, in and below the top of this opening, and this is shown in dot- and dash-lines at the left in FIG. 4, with the top wall 4 of the outer cap at 4' and the opening 3 being also at 3', the top surface of wall 4' being at the end of the arrow indicating cap 1.

What is claimed is:

1. A tamper evident safety closure, to safely close containers, which closure comprises an assembled combination of an inner cap housed in and surrounded by an outer cap and whereby the inner cap is provided with means to screw it onto a container to be closed, at least part of the outer cap being axially movable with respect to the inner cap, with resilient means to urge the caps axially away from each other and means to limit such axial movement and thus avoid separation of the caps from each other, cooperating camming means on both caps so as to allow screwing of the inner cap onto a container without depressing the outer cap down onto the inner cap and to allow rotation of the outer cap in the offscrewing direction without rotation of the inner cap, in which the camming means of the outer cap pass the camming means on the inner cap, said camming means on both caps entering into engagement with each other to cause rotation of the inner cap with the outer cap in the offscrewing direction only upon depression of the outer cap, the inner cap having a central upstanding part and the outer cap having a top end wall with a central opening bridged by a wall portion connected thereto by a rupturable connection, so that, on depressing the outer cap the said upstanding part of the inner cap contacts said bridging wall portion and ruptures it from said top end wall of the outer cap, and in which at least one of the parts, the upstanding part of the inner cap and the bridging wall portion on the outer cap, cooperating for rupturing the connection on depressing the outer cap, has an asymmetrical shape with respect to at least one of the references, constituted by the central vertical axis of the closure and a plane perpendicular thereto, so that depression of the outer cap will load the connection between the bridging wall portion and the top end wall of the outer cap differently in different zones along the periphery of said wall portion and, said bridging wall portion is also connected in at least one zone around its periphery to the outer cap by a non rupturable connection, there being an eccentric weakening in said bridging wall portion close to said non rupturable connection, which weakening is embodied by its material, dimensions and shape, so that it deforms lastically at an upward load, exerted in the rupturing direction by the inner cap upon depression of the outer cap.

2. A closure according to claim 1, in which in said bridging wall portion an opening is provided as the weakening, at least one narrow part of the said wall portion extending along at least one side of said opening and between the opening and the outer periphery of said wall portion, which narrow part will deform plastically upon depressing the outer cap.

3. A closure according to claim 2, in which the said opening is symmetrical with respect to a line through the center of said wall portion and through said non rupturable connection, said opening is longer perpendicularly to said line than along said line and said opening has an outer borderline being substantially parallel to the outer periphery of said wall portion.

4. A closure according to claim 1, in which the rupturable connection is embodied by its material, dimensions and shape so that it will only rupture at such an upward load higher than the load for plastically deforming said bridging wall portion in the weakening close to said non rupturable connection.

5. A closure according to claim 1, in which at least one of the cooperating surfaces of the said bridging wall portion of the outer cap and of said central upstanding part of the inner cap, causing the rupturing upon depressing of the outer cap, extends towards the other one of said surfaces to a varying extent, at least near the periphery of said at least one surface, so that on depressing the outer cap the surfaces will first enter into contact for exerting an upward load on the bridging wall portion in one peripheral zone thereof only.

6. A closure according to claim 5, in which one of said surfaces is inclined with respect to said direction of depressing.

7. A closure according to claim 5, in which one of said surfaces has a cam at its periphery directed towards the other one of said surfaces.

8. A closure according to claim 5, in which one zone the said bridging wall portion is connected by a non rupturable connection to the top end wall of the outer cap and has a weakening, which is embodied by its material, dimensions and shape so that it deforms plastically at an upward load, exerted in the rupturing direction by the inner cap upon depression of the outer cap.

9. A closure according to claim 8, in which the said one peripheral zone, where the said surfaces will first enter into contact for exerting an upward load on the bridging wall portion on depressing the outer cap, is in the same zone outside the center of said bridging wall portion where said weakening therein is provided.

10. A closure according to claim 8, in which the said one peripheral zone, where the said surfaces will first enter into contact for exerting an upward load on the bridging wall portion on depressing the outer cap is in a zone at the outer side of the center of said bridging wall portion than where said weakening therein is provided.

11. A closure according to claim 1, in which the rupturable connection consists of a plurality of discrete connections around the periphery of the bridging wall portion.

12. A closure according to claim 1, in which the rupturable connection is a continuous connection around at least the greater part of the periphery of the bridging wall portion and thinner than this wall portion.

13. A closure according to claim 12, said continuous connection having a thickness in the depressing direction of the outer cap, which varies around the periphery of the bridging wall portion.

14. A tamper evident safety closure to safely close containers, which closure comprises an assembled combination of an inner cap housed in and surrounded by an outer cap and whereby the inner cap is provided with means to screw it onto a container to be closed, at least part of the outer cap being axially movable with respect to the inner cap, with resilient means to urge the caps axially away from each other and means to limit such axial movement and thus avoid separation of the caps from each other, cooperating camming means on both caps so as to allow screwing of the inner cap onto a container without depressing the outer cap down onto the inner cap and to allow rotation of the outer cap in the offscrewing direction without rotation of the inner cap, in which the camming means of the outer cap pass the camming means on the inner cap, said camming means on both caps entering into engagement with each other to cause rotation of the inner cap with the outer cap in the offscrewing direction only upon depression of the outer cap, the inner cap having a central upstanding part and the outer cap having a top end wall with a central opening bridged by a wall portion connected thereto by a bridge rupturable connection, so that, on depressing the outer cap the said upstanding part of the inner cap contacts said bridging wall portion and ruptures it from said top end wall of the outer cap, and in which said bridging wall portion is formed of permanently deformable plastics material and has a weakened part positioned eccentrically therein close to part of said rupturable connection, the part of said rupturable connection close to said weakened part being less easily rupturable than the remainder of the rupturable connection, the strength of said rupturable connection and the deformability of said bridging wall portion in the area of said weakened part being such that, when depressing the outer cap, said bridging wall portion is deformed plastically before the said rupturable connection is fully ruptured.

15. A closure according to claim 14, in which the rupturable connection between the bridging wall portion and the top end wall of the outer cap is more massive and so less easily rupturable in the peripheral area adjacent said weakening than in the remainder of the peripheral area between the bridging wall portion and the top end wall of the outer cap around said central opening.

16. A closure according to claim 15, in which said more massive connection is so more massive than the connection in the said remainder of the peripheral area that the latter will fully rupture before the former has ruptured as a result of depressing of the outer cap.

17. A closure according to claim 14, in which said bridging wall portion has an eccentric through-opening leaving a narrow part in said wall portion between said opening and the outer periphery of said wall portion of such plastic deformation.

18. A closure according to claim 17, in which said opening is symmetrical with respect to a line through the center of said bridging portion, is longer perpendicularly to said line than along said line and has a curved outer periphery substantially concentric with the outer periphery of said wall portion.

19. A closure according to claim 15, in which the rupturable connection is embodied by its material, dimensions and shape so that it will only rupture at such an upward load higher than the load for plastically deforming said bridging wall portion in the weakening close to said non rupturable connection.

20. A closure according to claim 19, in which in one zone the said bridging wall portion is connected by a non rupturable connection to the top end wall of the outer cap and has a weakening, which is embodied by its material, dimensions and shape so that it deforms plastically at an upward load, exerted in the rupturing direction by the inner cap upon depression of the outer cap.

21. A closure according to claim 19, in which the said one peripheral zone, where the said surfaces will first enter into contact for exerting an upward load on the bridging wall portion on depressing the outer cap is in a zone at the other side of the center of said bridging wall portion than where said weakening therein is provided.

22. A closure according to claim 20, said continuous connection having a thickness in the depressing direction of the outer cap, which varies around the periphery of the bridging wall portion.

* * * * *